US005097734A

United States Patent [19]

Hunter et al.

[11] Patent Number: 5,097,734

[45] Date of Patent: Mar. 24, 1992

[54] OPEN FRAME PUNCH PRESS WITH PUNCHING REACTION FORCE NEUTRALIZING SYSTEM

[75] Inventors: James R. Hunter, Chadds Ford; George Jaworski, Bala Cynwyd, both of Pa.

[73] Assignee: Murata Wiedemann, Inc., King of Prussia, Pa.

[21] Appl. No.: 558,099

[22] Filed: Jul. 25, 1990

[51] Int. Cl.[5] ..... B21D 37/00

[52] U.S. Cl. ..... 83/639.1; 72/455; 83/859; 100/231

[58] Field of Search ..... 83/639.1, 701, 859, 83/615; 72/455; 100/214, 231

[56] References Cited

U.S. PATENT DOCUMENTS 3,561,252 2/1971 Norton ..... 72/455
4,073,180 2/1978 Pahnke ..... 72/455 X

FOREIGN PATENT DOCUMENTS 0631361 11/1988 U.S.S.R. ..... 100/214

*Primary Examiner*—Douglas D. Watts
*Assistant Examiner*—Clark F. Dexter
*Attorney, Agent, or Firm*—John R. Benefiel

[57] ABSTRACT

A system is disclosed for neutralizing the punching reaction forces in an open frame punch press in which inclined primary links mounted on the upper and lower frame members are stressed by linkage actuators during punching so as to counteract the punching reaction force. In one embodiment, a charging cylinder mounted to be acted on by the punch ram actuator generates hydraulic pressure used to operate linkage actuators. In that embodiment, the primary links are combined with secondary links to form toggle linkages to enable mechanical force multiplication of the force applied by the linkage actuators. In another embodiment the primary links converge and are pivotally connected at their rear ends to each other and a single secondary link, with a single cylinder at the forward end of one of the primary links, placing the primary links in tension during punching operations to neutralize the punching reaction forces acting on the press frame.

6 Claims, 4 Drawing Sheets

OPEN FRAME PUNCH PRESS WITH PUNCHING REACTION FORCE NEUTRALIZING SYSTEM

This invention concerns presses and more particularly open frame punch presses such as J or C frame configurations. Such presses conventionally are equipped with rams to drive a punch through a sheet material workpiece and into a mating die. The punching load tends to deflect opposing upper and lower frame members of the press frame, causing these members to move apart slightly. This deflection disturbs punch and die alignment, reducing tool life and degrading the smoothness of the edge of the hole punched.

Furthermore, recoil of the deflected upper and lower frame members at the instant of fraction of the sheet material as the hole is punched, produces significant undesirable vibration and noise by inducing vibration of the press covers and the sheet metal workpiece.

There has heretofore been devised a C-frame press having a system for counteracting the punching reaction forces and the resulting deflection of the opposing upper and lower frame members. Such a press is described in U.S. Pat. No. 3,561,252, issued on Feb. 9, 1971 for "Presses" in which a link is mounted attached at one end to one of the C-frame upper or lower members extending across the throat of the press to a hydraulic cylinder which is pressurized by hydraulic fluid from a punching ram. The link is thereby placed in tension simultaneously with the punching operation, the tensile force counteracting the force of the punching ram to eliminate press deflection.

This arrangement has the disadvantage of restricting at least partially the throat opening of the press. In a second version, apparently intended to alleviate this problem, the cylinder is located at the rear of the press, slowing the response time due to the length of the connecting hydraulic lines.

SUMMARY OF THE INVENTION

The present invention comprises a system for eliminating press deflection by mounting one end of a respective primary link to the outer end of each of the upper and lower frame members. Each of the links is angled with respect to the associated frame member and is stressed simultaneously with the punching operation to a sufficiently high level so that a neutralizing component force is generated, aligned with and just offsetting the punching reaction force.

The primary links are angled but extend in the same general direction and along the upper and lower members respectively, of the press frame so as to not intrude into the throat opening, and access thereto by the workpiece is unrestricted.

In a first embodiment, each primary link is inclined to diverge from the other and forms one half of a toggle linkage, pinned to one end of a secondary link, the other end being pinned to the rear of the press frame. The toggle linkage enables considerable leverage to be exerted by an associated linkage actuating cylinder having a vertically oriented ram connected to drive the pinned together ends of the primary and secondary links, causing compressible stressing of the primary link so as to apply the offsetting force to the associated frame upper or lower member.

The primary and secondary link sets may be arranged in pairs on either side of the press to achieve balancing of the forces across the width of the press.

The forces exerted by the linkage actuating cylinders is at a level calculated to generate a force component aligned with the punching ram just equal to and thus offsetting the punching reaction separating force to thereby eliminate any separation of the frame upper and lower members during punching operations.

The actuating cylinders are preferably pressurized from a charging cylinder directly mounted on one end of the punch ram cylinder, activated under a servo valve control to drive the punch tooling. The force acting on the punch ram cylinder is thereby exerted on the charging cylinder to pressurize the fluid in the linkage actuating cylinders to the appropriate level to generate a neutralizing force acting against the punching reaction forces, to eliminate deflection of the frame upper and lower members.

In a second embodiment, the primary links converge and are pinned to each other and to a single short secondary link at the middle of the press and extending horizontally to the rear. A single cylinder operates to place one of the primary links in tension, which also places the other primary link in tension so as to apply a neutralizing force to the upper and lower frame members.

The cylinder is thereby located closely adjacent the press ram to shorten the length of the hydraulic line and improve response times.

The cylinder may be pressurized by connections to the servo valve to eliminate the need for a separate pressure generating cylinder.

DETAILED DESCRIPTION

In the following detailed description, certain specific terminology will be employed for the sake of clarity and a particular embodiment described in accordance with the requirements of 35 USC 112, but is to be understood that the same is not intended to be limiting and should not be so construed inasmuch as the invention is capable of taking many forms and variations within the scope of the appended claims.

Figure 1:
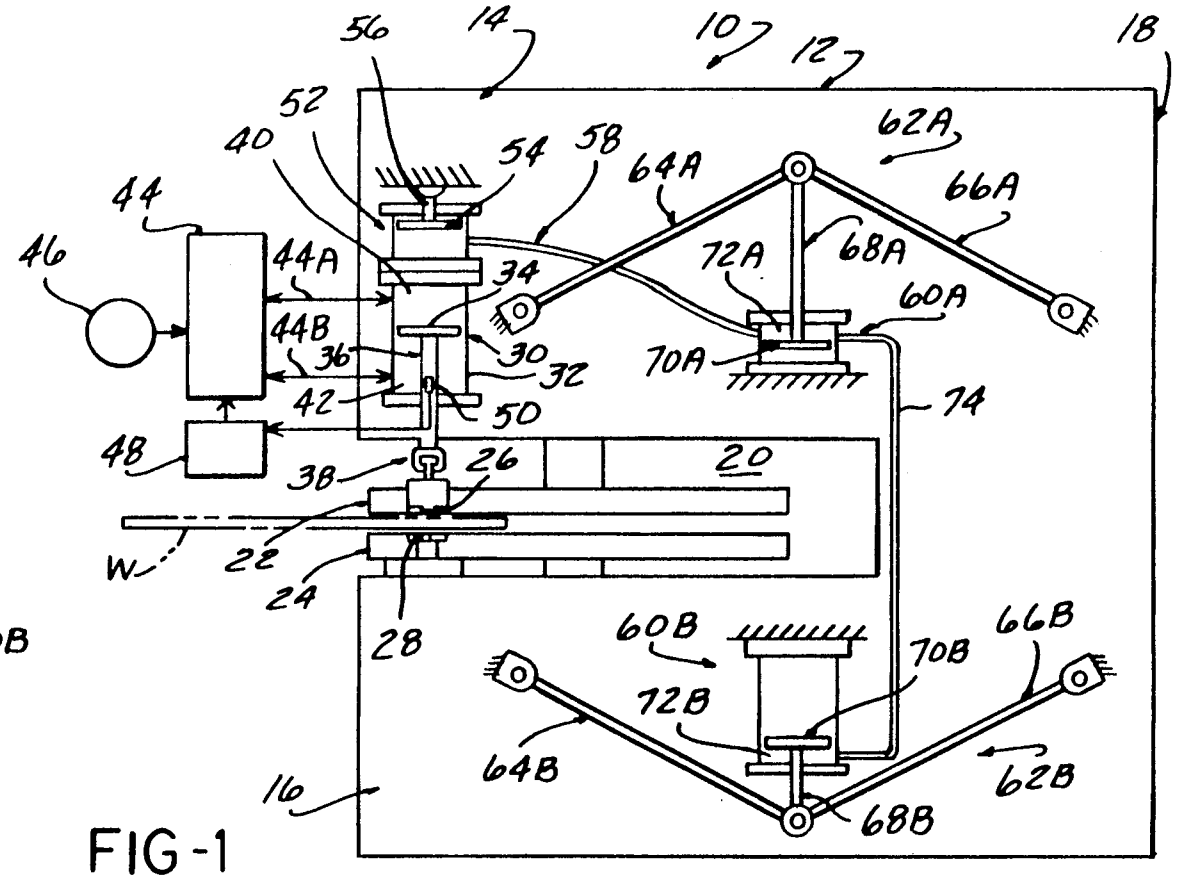
FIG. 1 is a diagrammatic representation of a C-frame punch press incorporating a punching reaction force neutralizing system according to the present invention.

Referring to FIG. 1, a punch press 10 is depicted diagrammatically having a C-frame structure 12 consisting of upper and lower horizontal members 14, 16 joined at the rear with an upstanding pillar portion 18. There is a gap between the upper and lower members 14, 16 defining the throat opening 20 of the press 10. Punch and die tooling is disposed in the opening 20, here shown as upper and lower rotary turrets 22, 24, the upper turret 22 carrying one or more punches 26, the lower turret carrying one or mating dies 28 in the manner well known in the art.

In the press shown, the punch 26 is adapted to be driven by a ram actuator 30 comprised of a cylinder 32 within which is slidably disposed a piston 34 attached to a rod 36 extending vertically downward and having an end piece 38 adapted to couple to the upper end of the punch 26. The spaces 40, 42, above and below the piston 34 are pressurized by a servo valve 44 controlling communication of these spaces via lines 44A, 44B with pressurized fluid from a source 46. The operation of the servo valve 44 is in turn controlled by a press controller circuit 48, which receives position feed back signals from a position feed back transducer 50 associated with the piston rod 36 and upper frame 14.

Suitable position transducers are widely available which generate an electrical signal corresponding to the position of the piston rod 36.

Thus, a feed back control system is established enabling the servo valve to control pressurization to drive the piston 34 and rod 36 through a selected punching cycle.

According to one aspect of the present invention, the upper end of the cylinder 32 opposite the rod 36 is attached to a charging cylinder 52. Charging cylinder 52 has a piston 54 slidably disposed therein, with a piston rod 56 attached thereto and protruding upwardly out of the cylinder 52, secured to the upper member 14 to be stationary relative the cylinder 52 (and actuating cylinder 32).

The space within the cylinder 52 beneath the piston 54 is filled with a suitable hydraulic fluid, which is pressurized by the stroking force exerted by the actuator cylinder 30 due to the end to end connection between cylinders 32, 52.

An outlet line 58, also charged with fluid, enables transmission of hydraulic pressure to a series of linkage hydraulic actuators 60A, 60B.

Linkage actuators 60A, 60B are connected to respective toggle linkages 62A, 62B to actuate these linkages by pressure developed in the charging cylinder 52.

Each toggle linkage 62A, 62B includes an elongated primary link 64A, 64B extending in the same general direction and along the associated upper and lower frame members 14, 16 but at an angle to the horizontal so as to diverge from each other, with the leading end attached to the outer end of the respective upper or lower press members 14 or 16. A secondary link 66A, 66B is pivotally connected to the other end of each primary link, pinned together with the end of a piston rod 68A, 68B attached to a piston 70A, 70B included in each actuator 60A, 60B. The other end of each secondary link 66A, 66B is pivotally connected to the upright rear press frame portion 18. Each secondary link 66A, 66B is similarly inclined and oppositely extending from a respective connected primary link 64A, 64B so as to form the toggle linkages 62A, 62B.

The actuators 60A, 60B are vertically oriented so that when the expansion space defined within the actuator 60A, 60B is pressurized by the charging cylinder 52, each primary link 64A, 64B is stressed in a direction tending to apply a force neutralizing the punching reaction force felt by the upper and lower press frame members 14, 16 respectively, i.e. to be compressed in the arrangement shown.

The upper linkage actuator 60A has a space 72A on the rod side of piston 70A communicating with the charging cylinder 52, so that the upward extending rod 68A is pulled down, causing the downwardly inclined primary link 64A to be compressed, applying a force having a vertical component to the upper press frame member 14.

The toggle linkage 62A allows multiplication of the force applied by the actuator 60A, and absorption of the reaction force by the secondary link 66A and rear member 18.

The various components are sized and oriented so as to generate a vertical component which is just equal to the punching reaction force applied to the upper member 14. The relative piston areas of the charging cylinder 52 and the linkage actuators 60A, 60B are selected to generate a sufficient force to create a punch reaction force neutralizing vertical force component on each press frame upper and lower member 14, 16.

The lower linkage 62B is connected to the downwardly extending piston rod 68B, and the space 72B beneath the piston 70B is pressurized by the charging cylinder 52 via a connecting line 74 so that the primary link 64B is compressed by upward movement of the piston 70B as the punching ram actuator 30 is operated. The upwardly inclined primary link 64B exerts a force on the lower press member 16 having a vertical component opposed to the punching reaction force. As noted, the system parameters are selected so that the vertical force component is just equal to the punching reaction force to neutralize the same and eliminate any press deflection.

Figure 2:
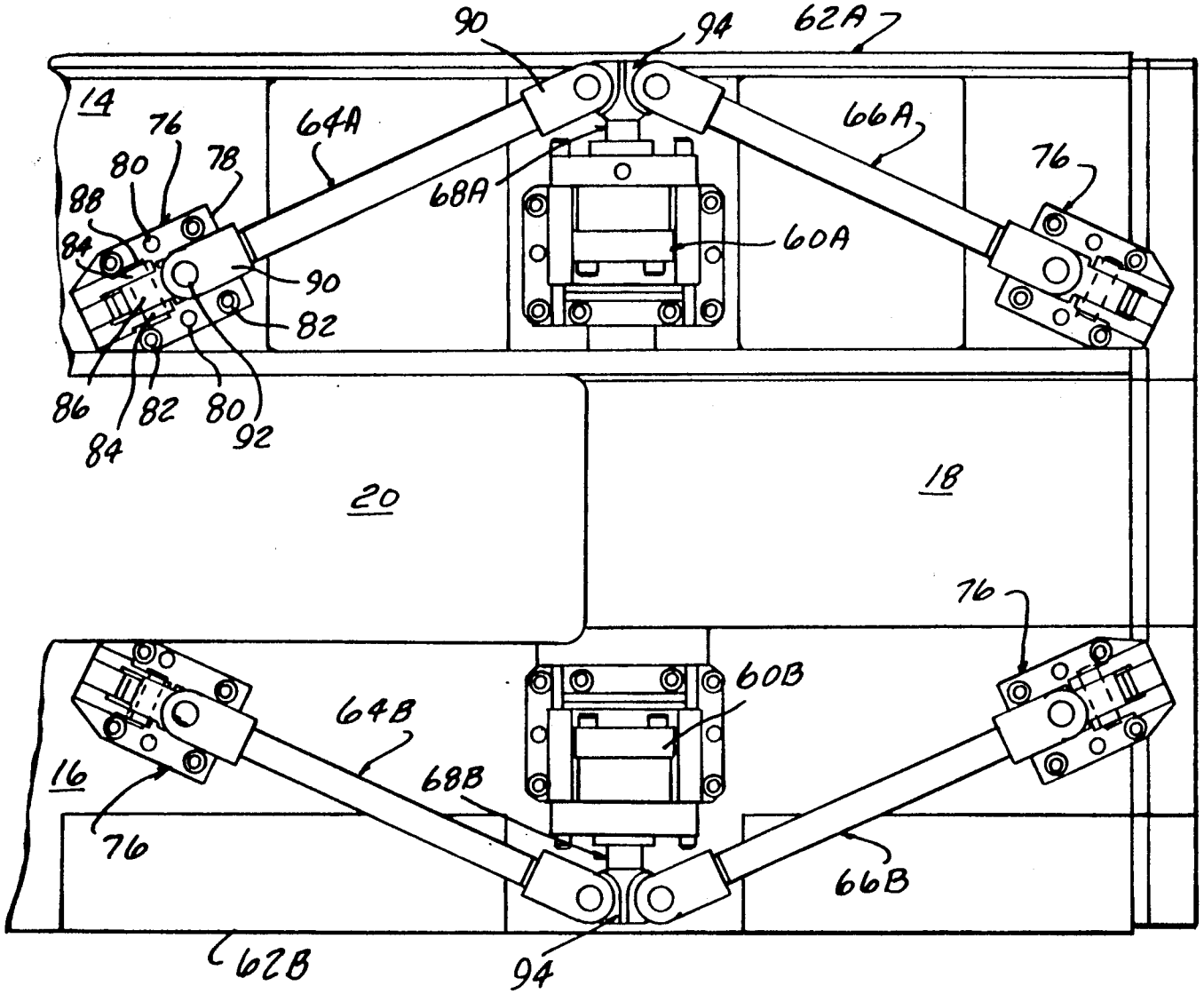
FIG. 2 is a side elevational fragmentary view of a C-frame punch press showing the details of the toggle linkage and linkage actuating cylinders utilized as a part of the punching reaction force neutralizing system according to the present invention.

FIG. 2 shows mechanical details of the upper and lower toggle linkages 62B, 62B. The outside ends of the primary and secondary links 64A, 64B, 66A, 66B are connected to the press frame by a clevis anchor 76. Each clevis anchor 76 includes a bracket 78 located with dowels 80 and secured with screws 82 to the press frame. Spaced apart ears 84 formed on the bracket 78 receive a swivel piece 86, pivotally mounted by means of a pin 88. Each swivel piece 86 is attached to a clevis end 90 attached to end of each link 64A, 64B, 66A, 66B. The outside ends are attached to a respective swivel piece 86 by means of a cross pin 92.

The clevis ends 90 of the inside end of each link 64A, 64B, 66A, 66B are attached in pairs to one of a pair of rod eyes 94 threaded to a respective piston rod 68A, 68B of each actuation actuator 60A, 60B.

The resulting swivel connections minimize binding in the linkages so that proper force alignment is maintained through the stroke range of the actuators 60A, 60B.

Figure 3:
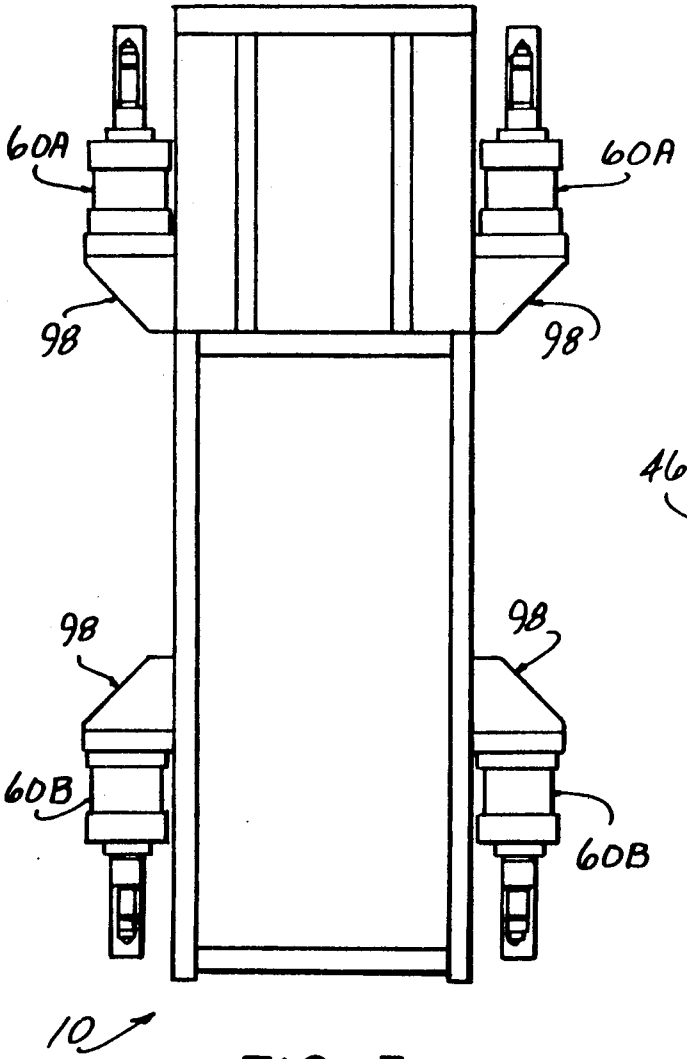
FIG. 3 is a rear view of the punch press showing pairs of linkage actuating cylinders on either side of the press, with the associated linkages removed for the sake of clarity.

FIG. 3 shows that pairs of upper and lower actuation actuators 60A, 60B are arranged on either side of the press 10, mounted to the press frame by means of brackets 98.

Opposite pairs of linkages 62A, 62B (not shown) are preferably provided to apply the neutralizing forces to the press frame upper and lower members 14, 16 symmetrically on either side thereof.

Accordingly, this system leaves the throat opening 20 clear to avoid interference of the linkages with the workpieces or the turrets 22, 24. It should also be noted that significant movement of the ram actuator 30 pushing the charging cylinder 52 under heavy press loads will not affect the proper stroking of the punch 26, as the position feed back control will drive the rod 36 through its programmed motion whatever movement the cylinder 32 undergoes.

Figure 4:
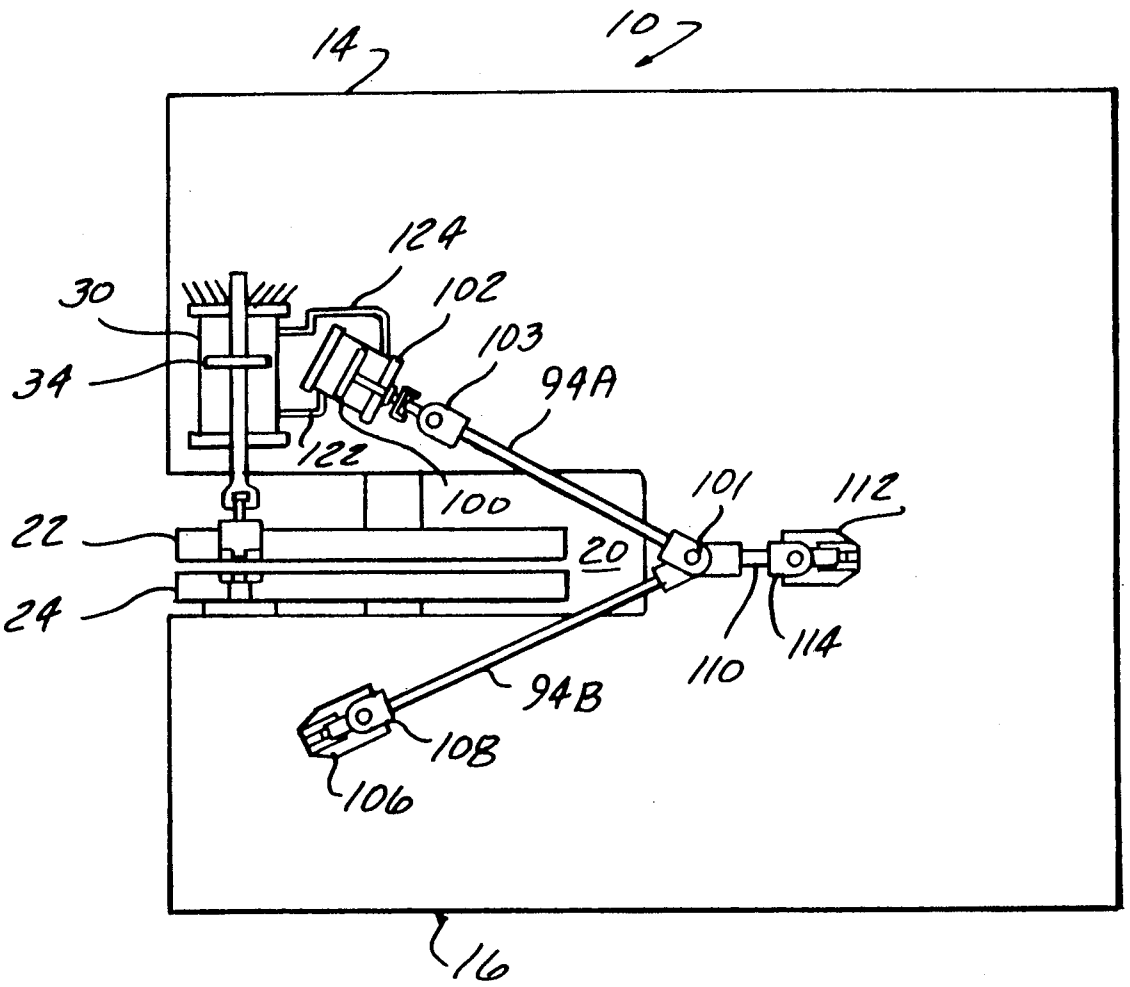
FIG. 4 is a diagrammatic representation of a punch press incorporating a second embodiment of the reaction force neutralizing system according to the present invention.
Figure 5:
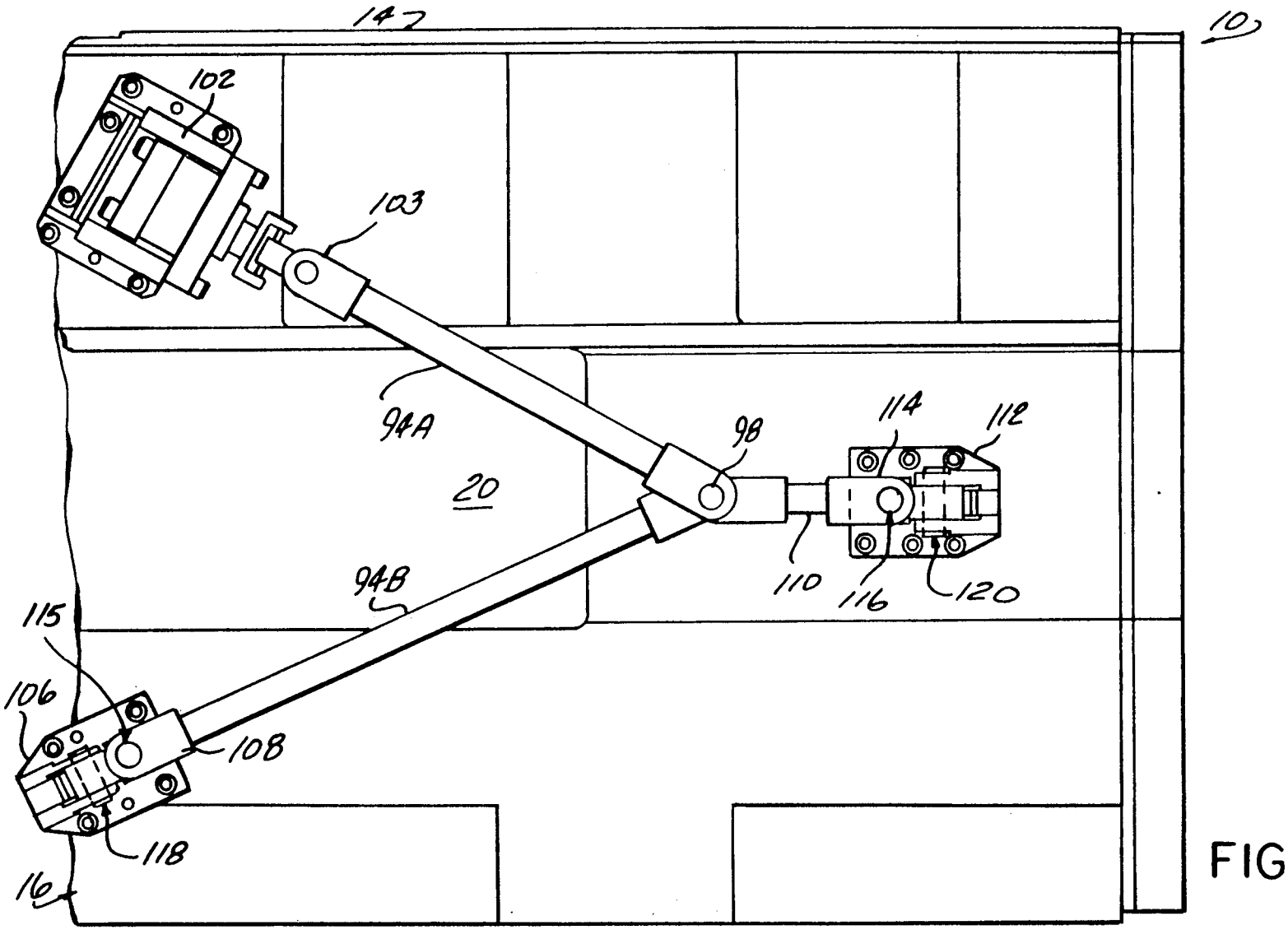
FIG. 5 is a fragmentary side elevational view of the linkages shown in FIG. 4.

FIGS. 4 and 5 show an alternative embodiment, which simplifies the system and reduces the response time by shortening the hydraulic lines.

In this embodiment, a set of upper and lower primary links 94A, 94B extend from the forward end in the same general direction of and along the upper and lower press frame members 14 and 16 respectively, but the upper primary link 94A is inclined downwardly at a shallow angle, the lower primary link 94B inclined upwardly at a shallow angle, converging together with the rear ends pinned together at a pivotal connection 101 located to the rear of the throat opening 20 of the press 10. The upper primary link 94A is pivotally connected at its outer, upper end by a clevis-swivel 103 to the piston 100 of a neutralizing actuator 102 mounted to the press upper frame member 14. The lower primary link 94B is pivotally mounted at its lower, outer end with a pivot bracket 106 and clevis 108 to the lower press frame member 16.

A relatively short secondary link 110 is also pivotally joined at its forward end to the pivotal connection 98, and extends horizontally towards the rear of the pillar member where it is secured with a pivot bracket 112 and clevis 114.

Each pivot bracket 106 and 112 allow swinging in the plane of the linkage about pins 115, 116 and also in a normal plane about cross pins 118, 120 respectively.

The actuator 102 is thereby located closely adjacent to the ram actuator 30 and has the upper and lower chambers above and below this piston 100 connected via crossing lines 122, 124 to the lower and upper chambers above and below the ram piston 34. Thus, the actuator 102 is operated by the same hydraulic pressure as the ram actuator 30, but in an opposite direction.

The upper link 94A is thus placed in tension when the ram actuator 30 is stroked to punch a workpiece.

This tension is also transmitted to the lower primary link 94B, since pulling action tends to pull the joint 101 up, and this action stretches the lower primary link 94B.

Thus, only a single actuator for each lever system is required, although the combined deflection of the upper and lower press frame members 14 and 16 must be made of up by the single actuator 102.

We claim:

1. In an open frame punch press having upper and lower spaced apart generally horizontal frame members connected by a rear pillar, said upper and lower members vertically spaced apart to form a throat opening at the front of said press, punch tooling mounted in said throat opening and ram actuation means for stroking said punch tooling to enable punching operations on a workpiece moved into said throat opening atop said lower frame member;

an improved system for neutralizing punching reaction forces comprising an upper primary link connected at one end to the front of said upper frame member and extending in the same general direction but moderately inclined along the upper frame member to the rear of said press;

a lower primary link connected at one end to the front of said lower frame member and extending in the same general direction but moderately inclined along the lower frame member towards the rear of said press;

said upper and lower primary links thereby not extending across said throat opening;

system actuation means stressing each of said upper and lower primary links only when said punching operation is being conducted to apply a force to each of said upper and lower frame members having a vertical component counteracting punching reaction forces to neutralize the same;

a pair of secondary links each pivotally connected at one end to the other end of a respective upper and lower primary link, each secondary link inclined oppositely from the connected primary link to form toggle linkages comprised of each set of said primary and secondary links, each other end of each of said secondary links pivotally connected to the rear of said press frame; and, said system actuating means including a pair of actuating rods, each driving the pivotal connection of one set of primary and secondary links to impose a stress on said primary links;

whereby avoiding deflection of said press upper and lower frame members from punching reaction forces.

2. The press according to claim 1 wherein said upper primary link is inclined upwardly extending from the front towards the rear of said press and said lower primary link is inclined downwardly from the front towards the rear of said press, said actuation means acting to compress said upper and lower primary links to apply said neutralizing force.

3. In an open frame punch press having upper and lower spaced apart generally horizontal frame members connected by a rear pillar, said upper and lower members vertically spaced apart to form a throat opening at the front of said press, punch tooling mounted in said throat opening and ram actuation means for stroking said punch tooling to enable punching operations on a workpiece moved into said throat opening atop said lower frame member;

an improved system for neutralizing punching reaction forces comprising an upper primary link connected at one end to the front of said upper frame member and extending in the same general direction but moderately inclined along the upper frame member to the rear of said press;

a lower primary link connected at one end to the front of said lower frame member and extending in the same general direction but moderately inclined along the lower frame member towards the rear of said press;

said upper and lower primary links thereby not extending across said throat opening;

system actuation means stressing each of said upper and lower primary links only when said punching operation is being conducted to apply a force to each of said upper and lower frame members having a vertical component counteracting punching reaction forces to neutralize the same, whereby avoiding deflection of said press upper and lower frame members from punching reaction forces;

said ram actuation means including a vertically extending ram cylinder defining a space, and a piston and rod member disposed in said space and coupled to said punching tool, means for directing pressurized hydraulic fluid into said space in said ram cylinder so as to drive said piston and rod and said coupled punch tooling upon pressurization of said space in said ram cylinder; said system actuation means including a charging cylinder means mounted to an upper end of said ram cylinder to develop a hydraulic pressure as said punch tooling is driven; means for applying said hydraulic pressure to stress said primary links to neutralize said punching reaction forces acting on said upper and lower frame members;

position transducer means associated with said ram cylinder and said piston and rod, and servo valve control means controlling pressurization of said ram cylinder, said servo valve control means responsive to said position transducer means to establish a position feedback loop controlling the drive of said punch tooling by said ram cylinder.

4. In an open frame punch press having upper and lower spaced apart generally horizontal frame members connected by a rear pillar, said upper and lower members vertically spaced apart to form a throat opening at the front of said press, punch tooling mounted in said throat opening and ram actuation means for stroking said punch tooling to enable punching operations on a workpiece moved into said throat opening atop said lower frame member;

an improved system for neutralizing punching reaction forces comprising an upper primary link connected at one end to the front of said upper frame member and extending in the same general direction but moderately inclined along the upper frame member to the rear of said press;

a lower primary link connected at one end to the front of said lower frame member and extending in the same general direction but moderately inclined along the lower frame member towards the rear of said press;

said upper and lower primary links thereby not extending across said throat opening;

system actuation means stressing each of said upper and lower primary links only when said punching operation is being conducted to apply a force to each of said upper and lower frame members having a vertical component counteracting punching reaction forces to neutralize the same, whereby avoiding deflection of said press upper and lower frame members from punching reaction forces;

said lower primary link extending from a forward point on said lower frame member, said upper primary link operatively attached to said upper frame member at a forward point, said upper and lower primary links extending rearwardly converging towards each other, each upper and lower primary link having a rear end, each of said rear ends pivotally connected together at a mid point just to the rear of the throat opening; and, a single secondary link pivotally connected at one end to said pivotally connected rear ends of said primary links, said secondary link extending horizontally to the rear therefrom, with the other end pivotally connected to said press frame.

5. The press according to claim 4 wherein said actuation means includes a neutralizing actuator connected to the forward end of one of said primary links and means for activating said actuator so as to place said primary link in tension upon operating said press to conduct a punching operation.

6. The press according to claim 5 wherein the forward end of the other of said primary links is pivotally mounted to said press frame lower member.

* * * * *